US012168919B2

(12) United States Patent
Mlinar

(10) Patent No.: US 12,168,919 B2
(45) Date of Patent: Dec. 17, 2024

(54) METHOD FOR ENHANCING OIL RECOVERY

(71) Applicant: Bruno Mlinar, Zurich (CH)

(72) Inventor: Bruno Mlinar, Zurich (CH)

( * ) Notice: Subject to any disclaimer, the term of this patent is extended or adjusted under 35 U.S.C. 154(b) by 81 days.

(21) Appl. No.: 17/625,666

(22) PCT Filed: Jul. 8, 2019

(86) PCT No.: PCT/HR2019/000018
§ 371 (c)(1),
(2) Date: Jan. 7, 2022

(87) PCT Pub. No.: WO2021/005383
PCT Pub. Date: Jan. 14, 2021

(65) Prior Publication Data

US 2022/0372854 A1 Nov. 24, 2022

(51) Int. Cl.
*E21B 43/16* (2006.01)
*E21B 43/24* (2006.01)

(52) U.S. Cl.
CPC ..... *E21B 43/16* (2013.01); *E21B 43/2401* (2013.01)

(58) Field of Classification Search
CPC ..... E21B 43/2401
See application file for complete search history.

(56) References Cited

U.S. PATENT DOCUMENTS 9,267,366 B2 * 2/2016 Parsche ..... E21B 43/2401
2011/0303413 A1 * 12/2011 Fairbanks ..... E21B 43/243 166/302

(Continued)

FOREIGN PATENT DOCUMENTS

RU 2648411 C1 3/2018
WO WO-2016045682 A1 * 3/2016 ..... E21B 43/16

OTHER PUBLICATIONS

International Search Report and Written Opinion for International Application No. PCT/HR2019/000018 mailed Mar. 30, 2020, 12 pages.

(Continued)

*Primary Examiner* — Nicole Coy
*Assistant Examiner* — Nicholas D Wlodarski
(74) *Attorney, Agent, or Firm* — LATHROP GPM LLP; Brian C. Trinque

(57) ABSTRACT

The method describes a way of improved oil recovery by the action of the electric field of the DC current and the electromagnetic field on the oil deposit (6) that is on the oil, the mentioned method comprises the following steps: a) Selection of the submerged rock clusters formations that contain the oil; b) Selection of one or more boreholes wells where the method will be applied; c) Extracting oil from at least one well borehole; Considering that the afore mentioned steps of the method further comprise of the following steps: A. Connected steel (17) and/or the upstream production tubing (16) of the boreholes wells with the DC electricity source 1 where the steel casings (17) and/or the upstream production tubing (16) assume the roles of the electrodes (7, 8); B. Connecting an electrical current source (1) with an electromagnetic field source (2); C. decreasing the affinity of the reservoir rock to capillary attract the oil, and simultaneously increasing the affinity of the reservoir rock to capillary attract water, reducing viscosity of the oil by applying the electric and magnetic fields, and increasing the electro osmotic flow of oil and layered water from the anode direction to the cathode direction.

20 Claims, 3 Drawing Sheets

(56) References Cited

U.S. PATENT DOCUMENTS

Figure 1:
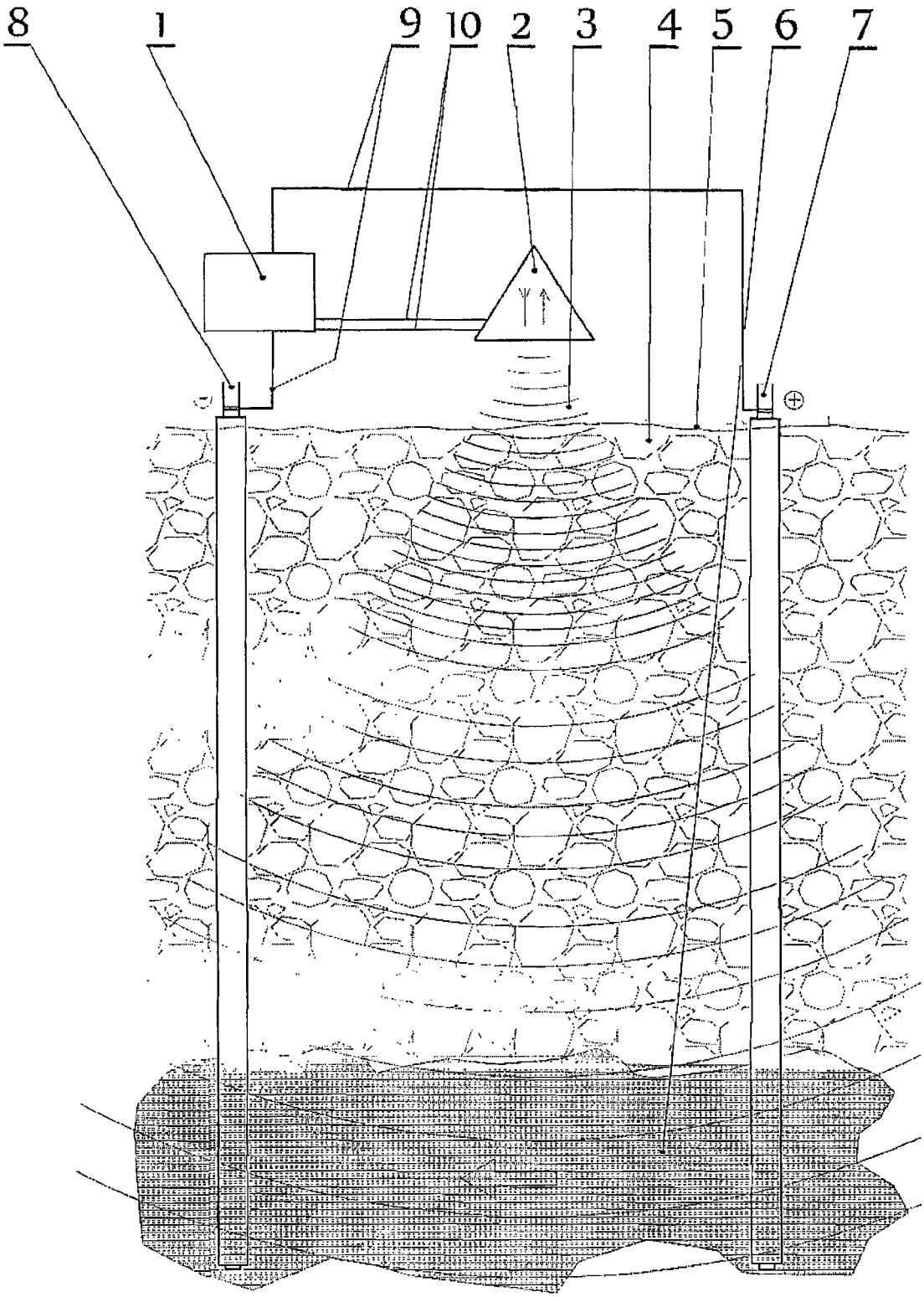

| | | | | |
|---|---|---|---|---|
| 2013/0112401 | A1* | 5/2013 | Guerrero | E21B 41/0085 175/57 |
| 2013/0277046 | A1* | 10/2013 | Haroun | E21B 43/26 166/248 |
| 2018/0230787 | A1 | 8/2018 | Stokholm et al. | |

OTHER PUBLICATIONS

Keglevic, "SPE-193778-MS In Situ Heavy Oil Upgrading by Electric Enhanced Oil Recovery, Complex Carbonate Heavy Oil Field Case Kresimir Keglevic, White Falcon Petroleum Technologies AG", retrieved from the Internet: https://www.onepetro.org/download/conference-paper/SPE-193778-MS?id=conference-paper%2FSPE-193778-MS, Dec. 2018.

* cited by examiner

METHOD FOR ENHANCING OIL RECOVERY

CROSS-REFERENCE TO RELATED APPLICATIONS

This application is a 35 U.S.C. § 371 filing of International Patent Application No. PCT/HR2019/000018, filed Jul. 8, 2021, which is incorporated by reference in its entirety.

AREA TO WHICH THE INVENTION RELATES

The present invention relates to a method of hydrocarbon recovery from sites which, by standard procedures, are deemed as unprofitable for hydrocarbon exploitation, as well as to a method for improving the utilization of hydrocarbon sites still in use and economically viable. The method of the present invention is based on the use of electric current and magnetic pulses. According to the international patent classification the present invention is classified under the subgroup E21B 43/16—Improvement of the separation method for obtaining hydrocarbons and under the subgroups E21B 43/25—Methods for stimulating hydrocarbon production.

THE STATE OF THE ART

So far, many methods of using electricity have been proposed for the purpose of increasing the production of crude oil and the final drainage from the oil deposit. Most of these methods are based on the various oil field deposit heating techniques also heating crude oil present in the deposit, with the aim reduce the viscosity of the oil and increase its mobility by increasing the overall temperature, also called the Joule heating. Most of these methods are based on the use of either alternating current or direct current that powers either special heaters lowered into the borehole in the area of the oil layer, this method implies the heating of the close surroundings of the borehole either by installing special electrodes in two separate boreholes and releasing between the electrodes and through the layer where either direct or alternating current which heats up the near-wellbore zone of the boreholes in which special electrodes are installed, or the entire oil bearing porous rock layer. One example of the method of applying an electric heater inside a borehole is shown in the patent specification US318787814A. In the mentioned invention, the heating is achieved by the passing of the electric current through the heating element of the heater installed in the borehole at the level of the oil bearing zone area while the heat from the heater is conveyed further by convection onto the fluids inside the borehole and the reservoir rock and onto the fluids of within the near-wellbore zone.

There is another invention which also uses the method of heating of the near-wellbore zone but in this invention heating is achieved by electrical induction, this method is described in the patent number WO2016130916A1.

The third invention utilizing electric energy to heat the oil layer, but in this patent heating is achieved by converting electricity to high-frequency waves, is described in the invention number CA 2637984.

There is one method utilizing alternating current for the heating of the reservoir rock and the fluids between the two boreholes with built-in electrodes, the aim of this method is to increase the mobility of oil in the deposit by increasing the temperature and consequently the amount of production and utilization of the reserves, this method is described in the invention number U.S. Pat. No. 3,605,888A.

All of the above described methods use the effect of reducing the viscosity of crude oil, and consequently increasing its fluidity (mobility) by heating or increasing the oil temperature, and this is achieved by applying electric energy transformed into heat energy in a variety of ways, either by inductive or resistive heating (passing of the electric current through a high resistance body) or heating flowback water existing into formation with the passing of the electrical current between the two electrodes built inside two distant boreholes that pump oil from the same oil layer and are hydraulically connected.

The closest to the state of the art presents a document published under number WO2016/045682, by ECP LICENS APS. It discloses a method of improved utilization of oil deposits by use of the electric potential for the capacitive charge of the media of the site where the oil is located and the reduction or maintenance of the potentials after the electric discharge of the said medium to about 40 mV per meter, which tracks leads to the extraction of oil on the surface or into the reservoirs. The document explicitly states that at least one electrode must be located either inside the borehole or close to the borehole. Furthermore, the document states that the method described may serve to improve the exploitation of the borehole with the medium ranging from sandstone to shale and that the described method can also be used to convert heavy oil into a light. Likewise, the document states that the method is based on the capacitive charge and discharge of the media and not on the electro osmotic flow or on any electrochemical reactions. However, this document does not provide any data on the tests carried out in oil fields with carbonate rocks or shale. The only test carried out was on an oil field with sandstone used as a medium. Firstly it should be emphasized that sandstone rocks are in most cases more porous than other reservoir rocks such as carbonates, dolomites and shales, and most often does not have double porosity which is a combination of rock and cracking porosity and secondly it should be noted that the oil field selected for the test method contains oil of relatively low viscosity 10-15 cP. Furthermore, the document remains silent and does not bring forth any quantitative data on the conversion of heavy oil into light oil in terms of viscosity reduction, except in terms of oil weight expressed in ° API. However, even such data show that oil after the application of the described method becomes heavier, and its weight during the application of the method decreases over time. Nevertheless, it is not clear when it reaches its initial value, i.e. how much time has to pass from the beginning of the application of the described method for the oil to reach the values in ° API lower than the initial default ones—see p. 21, lines 5 to 15 of the quoted document. In addition, it should be kept in mind that the most relevant information on reducing the weight of oil are the viscosity reduction data. Data on the change in the initial viscosity of the oil in the cited document are missing.

Furthermore, the state of the art also describes a document published under U.S. Pat. No. 687,556 B2, submitted by the company Electro-Petroleum Inc. The document describes the method of tertiary production of oil by applying direct current between two or more electrodes, with the cathode being installed inside the borehole, while the anode is a specially constructed borehole designed is such a way that inside of it the anode electrode is installed. (Page 5, lines 11-16). The described procedure is very expensive in application because in the installation process it is necessary to remove the existing equipment from the borehole and in the case of cathode installation it is required to install special equipment necessary for the application of the method, while for the anode installation is required to make a separate borehole. Furthermore, the described method requires the establishment of a relatively high voltage between the two electrodes, ranging between 0.4 V and 2 V for each meter of distance between electrodes electrode distance meter (page 16, application number 6). Considering that the boreholes are usually separated by 300 to 500 meters, such a gradient requires 500 meters of hypothetical distance between two boreholes and between 200 V and 1000 V of electric power voltage gradient, thus resulting in a very high electrical energy consumption and accelerated corrosion on the anode. Within the document it is also stated that the reduction of oil viscosity is achieved by electrochemical reactions that is by redox reactions initiated by electrolytic decomposition of layered formation or pressurized injected water to hydrogen and oxygen that subsequently bond with long chains of hydrocarbons, more precisely hydrogen in chemical reactions of reduction and oxygen in chemical reactions of oxidation. However, according to the findings of electrochemical reactions in soils and rocks, if the electric potential between two electrodes is above 200 mV per meter of distance between electrodes, the electrochemical reactions of reduction and oxidation must occur at or near the electrodes. As a reference you can see D. Rahner, H. Gruenzig "Die Anwendung elektrochemisher Verfahren zur Sanierung kontaminierter Boeden—Stand and Probleme, in: Umvelbundesamt, Verfahren zur elektrochemishen Sanierung yon Alstandorten, Berlin 1994." (Application of electrochemical processes for electrochemical purification of polluted soil conditions and problems, in Electrochemical Purification Processes of Polluted Land, Berlin 1994. Given the above-mentioned problem, most of the oil would be subjected to electrochemical reactions, the electrodes of the invention under number U.S. Pat. No. 687,556 B2 should be placed very close to each other, which is not economical or if the invention is to be applied by incorporating special electrodes into existing boreholes, the vast majority of oil in the deposit would not have be subjected to electrochemical reactions as the boreholes are spaced 100 or more meters from each other, depending on the geological structure of the deposit, on the method of obtaining crude oil and on the characteristics of crude oil in the deposit.

TECHNICAL PROBLEM AND TECHNICAL SOLUTION

From the above presented facts arises the conclusion that the relevant state of the art does not provide an answer to the reduction of oil viscosity and the exploitation of oil fields rich with containing of very high viscosity, i.e. of viscosity levels from 10 to 1000 time higher than the viscosity levels described in the document published under No. WO2016/045682. Thus, the technical problem that is to be solved by the present invention is the exploitation of oil fields where oil of very high viscosity is extracted, i.e. the gradual conversion of heavy oil into light oil, i.e. into light fractions in the oil deposit itself, with the same length of the entire deposit between the two boreholes-electrodes, not just at or near the boreholes-electrodes.

Another aim of the present invention is to exploit oilfields whose medium is shale and/or carbonate rock, resulting in a substantial reduction of costs in relation to the standard methods and to the methods described in the previously quoted state of the art.

Also, the object of the invention is to exploit already existing, naturally generated electric fields within the very oil deposit, that is the natural effect known as the telluric current and spontaneous soil potential.

Furthermore, the aim of the invention and the problem solved by the present invention is to eliminate the drawbacks of the method disclosed in documents number WO2016/045682 and U.S. Pat. No. 687,556 B2, which are primarily related to the need to place special electrodes inside the borehole, or near the borehole. In the first case, this brings a number of complications and increases in the cost of technology utilization due to additional works associated with lowering and installing special electrodes inside the borehole, which in cases of application on boreholes with marginal production means that such use of technology becomes unprofitable.

In the second case, where one of the electrodes, i.e. the anode electrode is placed on the surface near the borehole in which the cathode is installed, the electric current and the field do not have an equal effect on the oil deposit which is further away from the borehole where the cathode is installed, nor does the vertical direction to the oil deposit, but it rather bends towards the cathode, in the direction parallel to the ground surface, which causes the effect of the electric field only close to the borehole where the cathode is installed, and this brings a significant reduction in utilization, since the electric field does not act on the parts of the oil deposit which are more distant to the borehole inside which the cathode is installed.

The aforementioned technical problems were solved in such a way that an electromagnetic field acts on the site and not only the electric field, while the electric circuit between two or more boreholes is closed using the constructions equipment already existing in the borehole, i.e. the steel casings and/or upstream production tubing. In other words, the present invention does not use the classical electrode and there is no need to place the electrode inside the borehole or near the borehole to ensure a homogeneous electrical field across the entire depth of the borehole.

In a particularly good version of the invention, the efficiency of the invention is achieved by alignment of the polarity and the frequency of the electric field which is formed by the closing of the electric current circuit from a direct current source, which may be continuous, pulsating or impulse, which is done by delivering electric current from on the surface throughout the oil deposit by using two or more oil wells as electrodes, the electromagnetic impulse emitted from the source of electromagnetic waves located on the surface and the existing, naturally-induced electric fields that already exist within the oil deposit and the rocks surrounding it. Such alignment results in interference between the electric fields from all sources, i.e. their maximum efficiency and superficiality of the electrical flows from each of the three sources mentioned, that is, the electric circuit between the boreholes, the surface of the electromagnetic field and the natural electric polarization present in the oil layer. Considering the fact that every soil, and thus the oil deposit as well, is already naturally polarized in a certain direction, by selecting the position of anodes and cathodes, and by directing the electromagnetic source from the surface in the direction of the already existing natural polarization of the soil, the best and most energy efficient results can be achieved. For the method it is important that at least one of the two sources of the electric field is aligned with the natural polarity of the oil deposit, i.e. either the polarity of the field between the boreholes—electrodes or the polarity of the surface of the electromagnetic source. Polarity synchronization means that the polarity of the externally induced electric field does not deviate more than 45 degrees from the direction of the polarity of the natural electric field present in the ground but also in the oil deposit. The direction of the natural polarity of the soil and the oil layer is determined by measuring the voltage between the two electrodes embedded in the ground and by moving the distance angle between one electrode with respect to another which remains fixed by 5 degrees, until completing the full circle of 360 degrees. The direction of the electrodes that measures the highest electrical current is taken as the direction of the natural polarity of the soil. To reach optimum results according to the present invention, it was designed a special source of magnetic field with which the oil deposit is treated from the surface.

Since the subject matter invention is not based on capacitive discharging because shale and especially carbonate rocks or dolomites due to their low porosity cannot ensure a positive effect of the capacitive discharge onto the oil drainage, according to the present invention there is no time and energy loss for capacitive charging of the rocks.

The synchronized action of an electric field established between one or more anodes and cathodes and an electromagnetic field emitted from the surface of the source located above the oil deposit affects the physical characteristics that affect the borehole production and the economic viability of the oil deposit. Both the electrical and the magnetic field affect the capillary forces in the deposit, i.e. they decrease the affinity of the reservoir rock to capillary attract the oil, simultaneously increasing the reservoir rock's capacity to attract capillary water, i.e. they facilitate the changes of the characteristics of reservoir rocks from oil-resistant oil wet to water-resistant water wet. Another effect is the increase in the flow of liquids—oil and water—contained in the oil layer, through the porous environment that makes the deposit due to the electro osmotic effect caused by the directed electric field. Since the intensity of the electro-osmotic effect depends primarily on porosity rather than the hydraulic fluid flow capacity of porous rock subjected to hydraulic pressure gradient (permeability), this effect can be used to squeeze out mobilize additional oil from the reservoir rocks characterized by a double dual porosity, or in the same deposit, the existence of a small porosity fractures of high hydraulic conductivity and the so-called matrix wall reservoir rock of high porosity but low hydraulic conductivity. The third action is the effect on the chemical composition of the oil in the deposit itself, in such a way that heavy and viscous to very viscous oil gradually turns into a lighter or less viscous oil.

Surprisingly, the present invention provides a reduction of oil viscosity for factor 10, thus enabling the exploitation of oil fields that contain very viscous oil. For example, by applying the process of the present invention, it is possible to reduce the viscosity of the oil from several tens of thousands of mPas to several thousand mPas.

Likewise, the surprising effect of the process according to the present invention is the content of oil that changes in a way that increases the proportion of saturated hydrocarbons and aromatic hydrocarbons and reduces the proportion of resin and asphaltene.

SUMMARY OF THE INVENTION

The present invention relates to a process for pumping producing crude oil from oilfields by applying direct current electric field, which can be continuous, pulsating or impulse and the pulsating magnetic field on the oil deposit that is on the oil, in such a way that steel castings 17 and/or production tubing 16 are used as electrodes 7, 8 whereby heavy oil is gradually transformed into a light oil while the magnetic field is generated by the passing of the current from the source of the DC 1 through the source of the magnetic field 2, where the source of the DC 1 provides a voltage of 5 to 100 mV per meter of distance between electrodes. In the case of an oilfield in which there are or can be placed at least two boreholes, for the cathode 8 and the anode 7 are used the upstream production tubings 16 or steel castings 17 or a combination of steel castings 17 and the upstream production tubings 16, In the case where on an oilfield only one bore can be installed, or only one existing borehole can be used to increase the usability of the deposit, then the cathode 8 uses the upstream tubing 16 located in the perforated core zone of the main borehole zone, and as the anode 7 are used castings casing or liner of the side borehole 17. Both the base borehole and the additional lateral conduit 23 have to penetrate through the same oil layer and maintain either by contact with it by perforating steel castings casing 17 and cement 15, either by impregnating completing as open hole the borehole sections which is passing through the oil layer. Oil is, after becoming less viscous, and when the additional effects of electro-osmosis and changes in rock's resistance wettability increase the way flow quantity of crude oil into the borehole channel, produced through the upstream tubing, separated from water and gas and saved it in the reservoirs using some of the known methods of mechanical lifting of oil from deposits, such as dehydration and separation.

Another aspect of the invention relates to the reduction of oil viscosity by the procedure described above, whereby lighter oil, which is more suitable for extraction from the oilfield on the surface, is produced.

The third aspect of the invention relates to improving oil quality by the process described above in terms of increasing the proportion of saturated hydrocarbons and aromatic hydrocarbons and reducing the proportion of resin and asphaltene in it.

The fourth aspect of the invention relates to an increase in the technologically possible recovery factor exploitation of the hydrocarbon deposit—crude oil by mobilizing the oil trapped in the burrs or cracks of the reservoir rock, which were so far immovable, and by altering the wettability of the rocks from oil resistant oil wet to water-resistant water wet and that is achieved by using the electro-osmotic effect that pushes the oil from porous but low hydraulic permeable parts of the deposits, such as, for example, dual porosity double-porosity-resistant reservoir rocks.

The energy supplied by the DC direct current source to the electrodes as well as the surface source of the electromagnetic waves ranges from 0.5 to 3 kWh depending on the type and composition of the reservoir rocks, the distance between the boreholes, the proportion of layered formation water in the deposit fluids and the salinity and the chemical composition of the layered formation water. The source of the magnetic field according to the present invention is at least one coil. In a good version of the invention, the source of the magnetic field is made of two coils, in a more preferred version of three coils, and in the most preferred of four coils.

Thus, the primary objective of the invention is the improved oil drainage recovery by applying the electric field of the DC and the electromagnetic field on the oil deposit or on the oil. A particularly good and preferable version of the invention uses the natural electric field of the oil deposit itself in such a way that the polarity of at least one of the external sources of energy is aligned with the direction of the natural polarity of the soil or the direction of the electric field naturally present in the soil or the oil deposit, where the said method comprises of the following steps:

a) Selection of underground oil deposits suitable for the application of the method and after the selection of the deposit, b) selection of one or more boreholes where the method will be applied c) Extraction of oil from at least one borehole; where the method among the said steps also comprises of the following additional steps:

A. Joints (17) connecting steel casings and/or upstream production tubings (16) of the borehole with a source of the direct current (1), whereby steel castings (17) and/or upstream production tubings (16) of the boreholes take over the role of the electrodes (7, 8);

B. connecting of the DC electricity source (1) with the electromagnetic field source (2);

C. decreasing the reservoir rock oil capillary attraction affinity, and simultaneously increasing the water capillary attraction affinity of the reservoir rock to capillary attract water, together with reducing viscosity of the oil by applying the electric and magnetic fields, and increasing the electro osmotic flow of oil and layered water from the anode direction to the cathode direction.

In a particularly preferred version of the invention prior to step A, first is to be performed the step encompassing the determination of the direction of the polarity of the naturally present electric field in the oil layer and then alignment of the polarity of at least one of the external sources of the electric field with the direction of the natural polarity.

In the most preferred version of the invention at the outlet of the borehole, a tubing system of electrically non-volatile material 12 is inserted into the collecting tubing system 11 which is connected to the rest of the collecting tubing.

In the execution of the invention it should be observed that casings 17 and tubing 16 are electrically insulated from the surface collecting system 11 by inserting tubes of nonconducting material 12 between the tubing 16 and the surface collecting tubing 11.

When anode and cathode use the same borehole with one basic channel and one or more side channels 23, the part of the borehole casing is replaced by electrically nonconducting material 22 which is closer to the end of the borehole from the outlet of the lateral channel 23 from the main borehole. Then the electric insulation between the tubing 16 and the casing 17 of the main borehole is ensured by the connection of the tubing 16 to the casing 17 at the top of the bore by tubing carrier hanger made of non-conductive material 20 and by the mounting of the annular spacers 21 on the tubing. In the case of the invention execution with one borehole, the rule is that the plus pole is connected to the casing 17 and the minus pole to the tubing 16. The flow of the deposit fluids to the annular space of the main borehole is in this case prevented by inserting packers 24 over the perforations 18 and the inlet fluid flow into the side channel space 23 prevents the insertion of the cap plug over perforations 18.

BRIEF DESCRIPTION OF DRAWINGS AND TERMS

Figure 2:
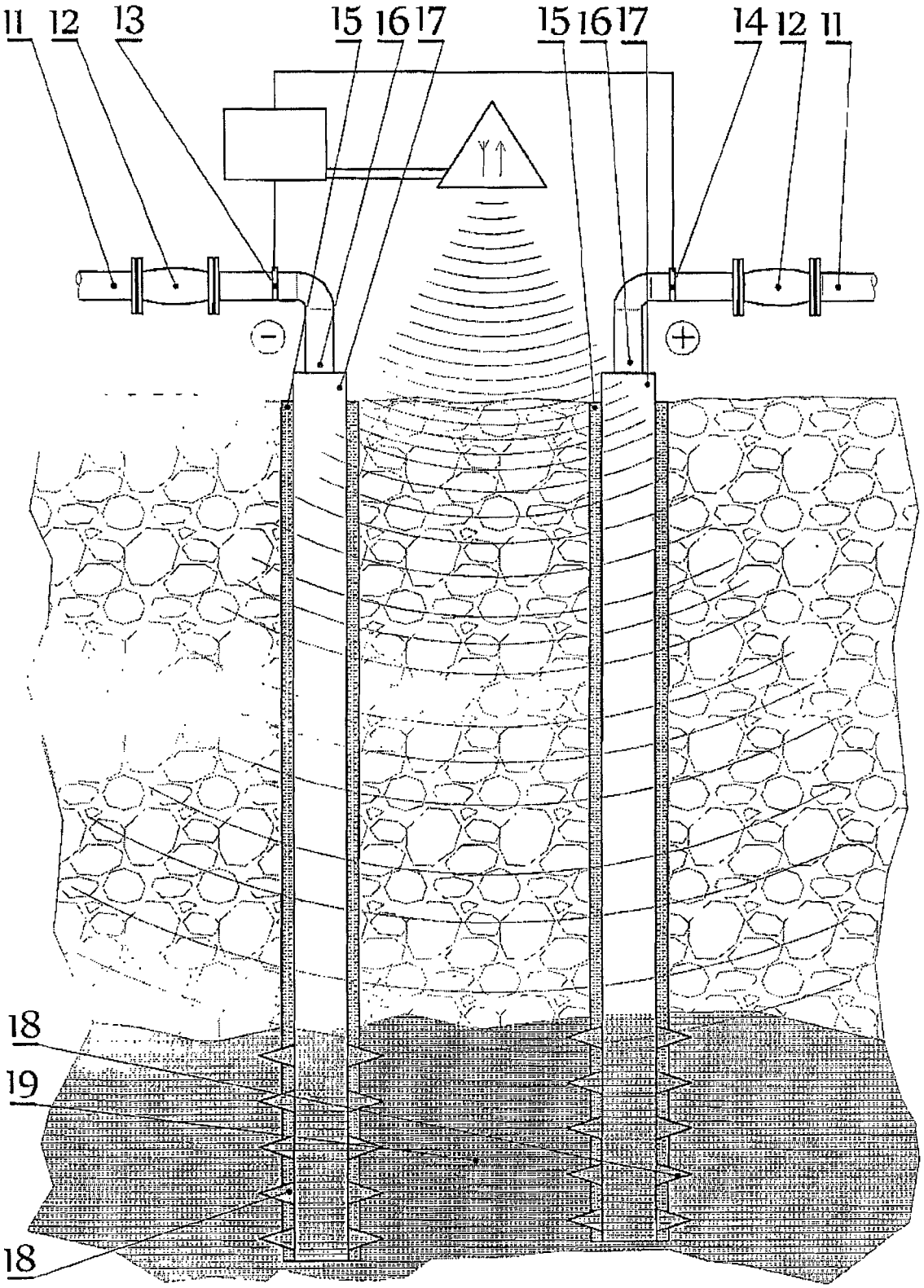
Figure 3:
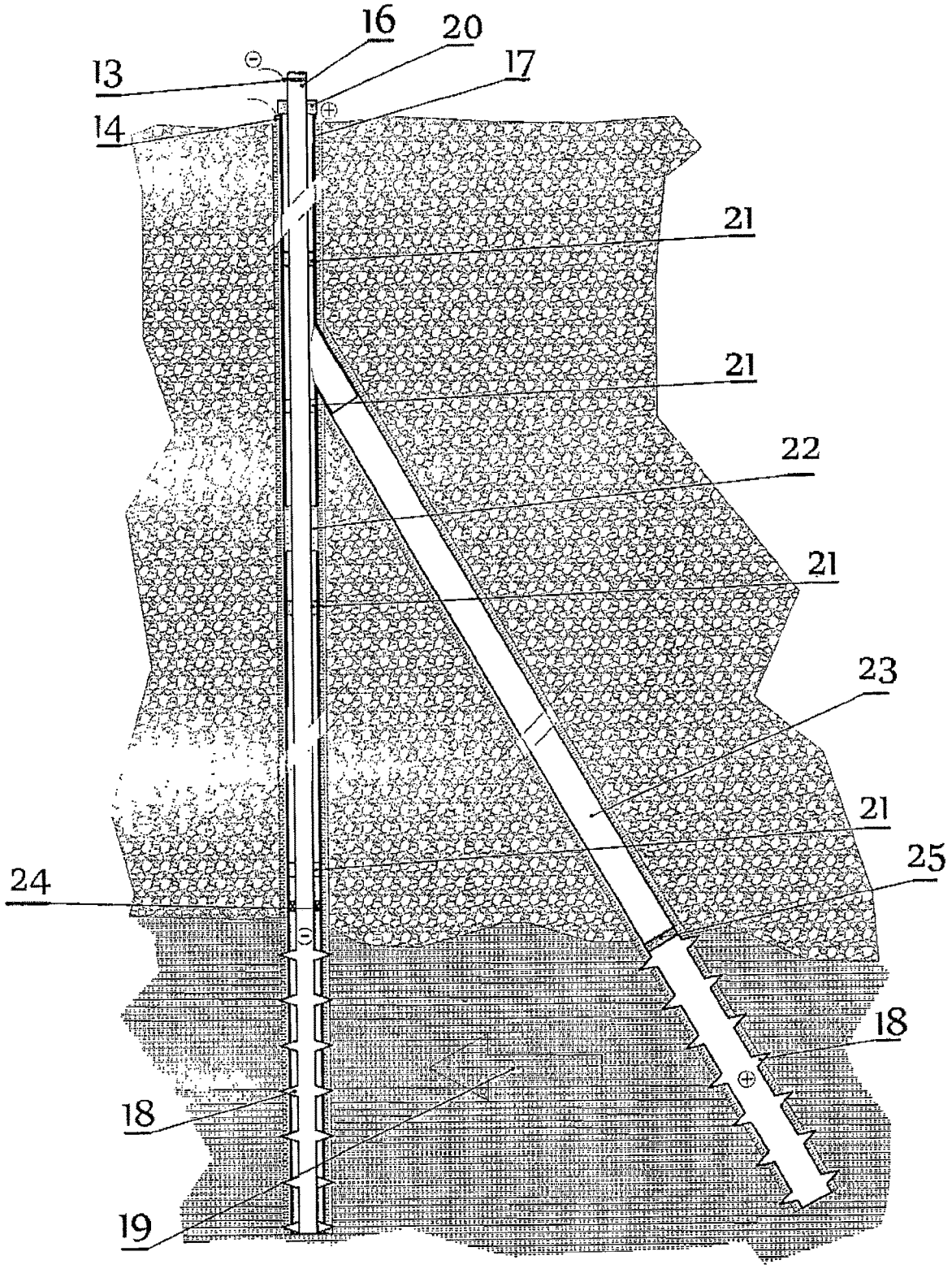

FIG. 1 is a borehole with a source of direct current connected to the electrodes and to the source of the magnetic field FIG. 2 shows the installation on the borehole according to the present invention FIG. 3 is a view of an execution of the present invention with a single borehole The terms on the drawings have the following meaning:

1—source of DC,

2—source of pulsating magnetic field,

3—pulsating electromagnetic field emitted from source 2 through ground 5 into the oil layer 6,

4—surface of soil (soil),

5—the soil above the oil bearing reservoir (overburden)

6—oil bearing layer that can be a sandstone, carbonate, dolomite, shale or other porous rock in which are present oil, water and gas,

7—anode—a conduit that penetrates into the oil layer. It can be an oil production borehole, water injection well, conserved or neutralized liquidated borehole, or some other conductive material that penetrates into the oil layer,

8—Cathode—producing borehole

9—electrical conductors in which the DC source is connected to the anode 7 and the cathode 8,

10—electric conductors by which the source of the electromagnetic waves 2 is connected to the direct current source 1 to achieve the interference of the signal i.e. electrical impulses that are fed from the source 7 to the layer 6 via the anode 7 and the cathode 8 and the electromagnetic impulses of the source 2 used to affect the oil layer 6,

11—a metal pipe that goes from the borehole into a collecting reservoir

12—a tube of electrically non-volatile nonconductive material such as, for example, rubber or plastic, is inserted to provide electrical circuit closure through the oil layer,

13—electrical contact connection of minus (negative) pole minus half of the direct current source with the borehole serving as the cathode. The contact is connected to a steel pipe connected on one side by the casing 17 and the tubing 16 and, on the other side to the inserted tube of the insulating material 12,

14—an electric contact plus half connection of plus (positive) pole of the direct current source with the borehole serving as the anode. The contact is connected to a steel pipe connected on one side by the casing 17 and the tubing 16 and, on the other side to the inserted tube of the insulating material 12,

15—cementation of the borehole. The cement layer between the casing 17 and the soil (sediment layers) through which the borehole passes provides partial electrical isolation between the casing 17 and the ground, enabling most of the electric energy to flow through the electric energy circuit closed through the oil layer between the anode and the cathode,

16—Tubing, that is the production tube of the borehole. Tubing is made of el. conductive material,

17—casing i.e. borehole casing. Casing is made of electrically conductive material,

18—perforations through a part of the casing and the cement which are passing through the oil layer and providing a contact of the oil layer with the borehole. Through these perforations oil, water and gas penetrate into the production borehole, while providing electrical contact with the layer,

19—the direction of closing of the electric circuit through the oil layer and the direction of action of the electric field,

20—electrical insulation between tubing and casing,

21—distancer i.e. a cylindrical device of electrically non-volatile nonconductive material which is mounted around the tubing and prevents the contact of the tubing and casing, thereby and consequently closing the electrical field,

22—the cut-off portion of the casing which can be subsequently filled with cement prevents the electric current flow through the casing to go deeper than the cut-off portion,

23—side borehole channel,

24—packer,

25—plug in the side borehole.

DETAILED DESCRIPTION OF THE INVENTION

The method is based on the effects caused by the action of a direct electric current flowing to the oil layer through at least two boreholes and passing through the oil layer, i.e. through the porous rock saturated with crude oil, water with dissolved salts and gas, with electromagnetic impulses from the surface source causing the additional polarization of the soil particles of which the oil layer is formed, i.e. causing induced polarization, water, and heavy metal particles, which are an integral part of the reservoir rock material. In a particularly preferred version of the invention, the direction of the natural polarization of the reservoir rocks is also taken into account, and the position of the anode and cathode is selected or the direction of the polarity of the electromagnetic field surface field is directed so that the induced polarization is as much in conformity with the direction of the natural polarization of the deposit.

In the basic version of the invention, the source of the direct current 1 acts together with the source of the electromagnetic impulses 2 to the oil layer 6. Electro magnetic impulse source is applied to ground surface 5 between two oil boreholes serving as electrodes thus emitting electromagnetic impulses 3. The electromagnetic impulses 3 extend through the soil above the oil layer 4 and act on the oil layer 6 causing induced polarization. The direct current source 1 is connected to the cables 9 by surface mountings or other suitable electrically conductive part of the boreholes about the surface of the earth. As electrodes, that is as anodes 7 and cathode 8, are used the existing boreholes that have the contact with the same oil layer 6 or that have hydraulic communication, but it is not essential that an oil borehole is used as the anode, as it can also be used a water injection well, a preserved borehole or any electrical conductive element, as long as the condition of the simultaneous contact between the borehole and the cathode 8 and anode 7 and the same oil layer 6 is fulfilled. The DC direct electric current source 1 is connected to the source of electromagnetic impulses (2) by conductors.

In the where when existing boreholes are used as a cathode (8) and anode (7), tubings of electrically non-volatile material (12) are connected to the outlet from the borehole to the collecting tubing system (11) which is connected to the rest of the collecting tubing in any convenient way to ensure leakproofness of all fluids and gases. In this version, as electric conductive element closing the circuit from the source (1) through the oil layer (6) and the electrodes (7) and (8) are used the existing electric conductive elements of the borehole such as casing (17) and/or upstream tubing (16). Electrical insulation and preventing the circuit is closed over the layers (4) above the treated oil layer (6) is achieved by means of a cement layer (15) which is already an integral part of the boreholes. In this embodiment, the DC current from the source (1) flows, i.e., the circuit is closed between the plus and minus poles, respectively between the anode (7) and the cathode (8) using the casing (17) and/or the upstream tubing (16) as electric conduits. The electric circuit is further closed by the perforations of the borehole (18) which enable the hydraulic and electrical connection between the borehole and the oil layer (6). The electric field operates from the anode (8) to the cathode (7). This embodiment is possible in such a way that more than one borehole is connected to the circuit, for example, that an anode is connected to multiple cathodes or multiple anodes to one cathode.

There are cases when one oil reservoir or layer is drilled from only one production borehole, due to the small volume of the reservoir or due to other reasons, for example when the reservoir is divided into blocks by faults and there is no hydraulic communication between the blocks. Also, in some cases it is economically profitable to treat all existing productive boreholes in a given field by a tertiary oil recovery method as described in this document. Also, it is possible that the elaboration of a certain oil field is planned in such a way as to produce boreholes that each make a separate hydrodynamic unit to be treated, using a method previously described in this document. In such cases, a new borehole must be made or the existing borehole must be adapted and equipped to serve both as an anode and as a cathode.

The possible way in which one borehole can be made or adapted to serve simultaneously both as the anode and as the cathode is shown in FIG. 3. As shown, it is possible to create and equip a new borehole or an already existing borehole. The borehole is made in such a way that one or more borehole channels, which can be under any angle in relation to the ground, is made one or more borehole channels or lateral canals 23. The electrical connection contact minus half pole of the direct current 1 source is connected to the tubing of the base borehole which serves as the cathode. The contact binds to the surface reinforcement or the surface-accessible steel tubing that is on one side connected by 17 and the upstream tubing 16, and on the other to the inserted tubing made of insulating material 12. Prior to connecting the minus pole, the tubing 16 is separated by a special device of electrically non-volatile nonconductive material 20 so as not to be in electrical contact with the casing 17 and also around the tubing 16 are incorporated special devices, the so-called spacers or distancers 21 of non-electrically conductive material in form of a hollow cylinder with an inner diameter sufficient for the tubing to pass through it. 16. Distancers 21, are incorporated in an arbitrary number which has to be sufficient to provide insulation, i.e. to prevent contact between the steel parts of the casing 17 and the tubing 16, thereby closing the electrical circuit between them. The anode or the positive pole bonds in a manner that is electrically coupled with the ascesion pipe or casing 17 and electricity flows through the casing of the core main borehole to the cut-off part of the casing 22 and the also through the length of the whole casing 17 of one or more lateral channels. The current circuit is closed through the oil layer 6 and the direction of the action of the electric field 19 is from positive polarized perforations 18 toward the negative polarized perforations 18. For the purpose of the present invention it is not important whether the perforations of the base and the lateral channels are positive or negative, it is important that they are polarized differently and that the circuit is closed through the oil layer 6 and through the perforation 18. Inside the basic borehole at any point above the perforation 16 and below the cut-out part of the casing 22 the packer 24 is inserted to prevent the fluids to flow into the annular space between the casing 17 and the tubing 16, while inside the lateral side cavity wellbore 23 above the perforations 18 a plug is to be made 25 to prevent the fluids to enter in the side borehole and then in the basic borehole. The cement layer 15 ensures electrical insulation between the borehole casing and the soil layer through which the borehole and lateral duct pass and ensures and this ensures that the electric circuit is closed exclusively through the perforations 18 and the petroleum layer 6. In this version, the surface source of electromagnetic impulses 2 is used in the manner described above.

Field Test

On the oil field that is on the deposit of very heavy and viscous oil, there are complex geological structures characterized by scattered fractured carbonate reservoir rocks of large permeability but very low porosity of deposits reservoir rocks, also with very high levels of groundwater bottom water (aquifer) pressure, low deposit reservoir temperatures and a very high viscosity of oil within the deposit oil reservoir. Such deposits are classified as marginally profitable and the tests which were performed show surprising efficiency of the process and installation according to the present invention.

Specification of the oilfield is given in Table 1:

TABLE 1 oil field parameters

| lithology | Fractured i.e. carbonate rock |
|---|---|
| Porosity | 2.5% |
| Permeability | 1 Darcy |
| Deposit temperature (° C.) | 40 |
| Static deposit pressure (bar) | 100 |

The test was made in conditions where the boreholes oil wells used as electrodes were set at the distance of 510 m one from the other. The depth of the borehole oil well used, according to the present invention, as a cathode is of 1210 m and the depth of the oil well borehole used according to the present invention as an anode is of 1219 m, both are cemented and tempered cased: cathode up to 1204 m and the remaining 6 m is not tempered cased, making it an "open hole" and the anode up to 1213 m is also cemented and tempered cased while the remaining 7 m is 'undone' not cased that is an 'open hole'. Those un cased or open hole completed 6 m at the cathode borehole that is 7 m in the anode borehole form a connection with the oil layer, i.e. the cementation and closure steel casing ceases on the top of the oil layer.

By performing surface measuring of the voltage between one of the static electrodes and the other electrode that is moving in five degree steps, the direction of the natural polarization of the field is determined, and the polarization direction of the electromagnetic field from the sources of electromagnetic waves is oriented to coincide with the direction of natural polarization. The boreholes were prepared in such a way that a series of upstream production tubes—tubings were extended up to half a meter from the bottom of the borehole to allow the upstream holes production tubing to enter the open hole section of the borehole. Both boreholes are prepared in this way.

The production of the borehole oil well planned to serve as a cathode was measured in such a way that the production of the borehole well is directed to a special reservoir, and by measuring the amount of oil and water in the reservoir that is daily emptied, it was established the average oil and water production immediately prior to the application of the invention. The production was measured in the same way after the start of the application of the invention, and oil and water production at the selected dates is shown in Table 2. Dec. 3, 2017 was the date of the begging of measuring and it relates to measurements prior to the initial date of method application and the measurements on dates later than that date refer to the time after the application of the method.

TABLE 2 oil production and water share in production before and after the application of the method

| Date of measurement | Oil produced (barrel per day) | Water share in total production (%) |
|---|---|---|
| 3 Dec. 2017 | 2.52 | 94 |
| 15 Jan. 2018 | 7.56 | 80 |
| 14 Feb. 2018 | 12.20 | 72 |
| 20 Mar. 2018 | 14.18 | 71 |
| 16 Apr. 2018 | 16.35 | 61 |
| 20 May 2018 | 17.20 | 52 |
| Jun. 18, 2018 | 18.91 | 47 |
| 22 Jul. 2018 | 24.60 | 39 |
| 20 Aug. 2018 | 29.25 | 34 |
| 19 Sep. 2018 | 32.15 | 31 |

The fluid level in the annular space was also measured using a sonolog acoustic device. The fluid level was monitored during the first month after the application of the invention to see the electro-osmotic effect. The increase in fluid levels, that is the reduction of the fluid level distance from the top of the boreholes, indicates the presence of the electro osmotic effect. Measurement results on Dec. 3, 2017 refers to the fluid level prior to the beginning of the method, and on the other dates after the beginning of the application of the method. For the entire time of the fluid level measurement in the annular space (annulus between well casing and tubing), the depth pump parameters have not changed, such as length of the piston stroke and the number of strokes per minute.

The fluid level in the annular space of the borehole oil well before and after the beginning of the application of the invention is shown in Table 3.

TABLE 3

Liquid level in the annular space of the borehole which was used as the cathode

| Date of measurement | Fluid level in the annular space of the borehole, measured from the mouth up to the fluid level (m) |
|---|---|
| 3 Dec. 2017 | 310 |
| 11 Dec. 2017 | 240 |
| Dec. 18, 2017 | 180 |
| 26 Dec. 2017 | 130 |
| 3 Jan. 2018 | 75 |
| 10 Jan. 2018 | 16 |
| 20 May 2018 | 18 |

Prior to connecting direct current sources, rubber tubings pipes were inserted into at surface outlets of the both boreholes oil wells, by replacing instead of a shorter short steel tubing part of surface gathering system to provide electrical isolation of the borehole from the surface produced fluids gathering collector system. Thereafter, the DC electricity source was connected via an electric cable mounted on the columns extending between the two boreholes oil wells serving as anode and cathode. Each side of the cable which represented plus pole (one side) and minus pole (other side) was connected with a steel pipe, which is further connected to one side on the casing and the tubing of the boreholes oil wells and, on the other, to the non-conductive pipe. and The insulated ends of the cables were clamped by clamps to the described steel tubing on both oil wells boreholes, and insulated by insulating tape. Subsequently, the DC electricity source was connected to the generating source of electromagnetic waves, which was placed in a perfectly flat position between two oil wells boreholes. Furthermore, the DC electricity source, which as a part includes an alternating current rectifier, was connected to a nearby AC electricity source.

After launching the invention, in addition to regular monitoring of the amount of oil and water produced, oil samples taken from the borehole oil well serving as a cathode were analyzed and compared with also laboratory-analyzed samples of oil taken from the same oil well prior to the start of the application of the invention.

The composition of the oil was determined by a column chromatographic method based on the principle of different absorption capabilities of certain types of compounds—SARA analysis.

The deasphalted sample is to be applied to a glass column filled with n-hexane and an adsorption agent (silica gel and aluminum oxide). The sample dissolved in n-hexane is applied to the column, eluting saturated hydrocarbons. Then benzene is gradually added to elute the aromatic hydrocarbons and a mixture of benzene and methanol which elute resins. Types of compounds are separated based on the growing polarity of the solvent used for elution. After separation and evaporation of the solvent, saturated hydrocarbons, aromates and resins were weighted. The mass of asphaltene is determined from the difference in the total mass and mass of said compounds. The results are given in Table 2 by mass %.

TABLE 4

The composition of the oil before and after the application of the process according to the invention

| Sample type | Saturated hydrocarbons (% by mass) | Aromatic hydrocarbons (% by mass) | NSO-resins (% by mass) | Asphaltenes (% by mass) |
|---|---|---|---|---|
| oil before treatment | 14.61 | 45.47 | 18.93 | 20.99 |
| oil after treatment | 18.05 | 48.28 | 14.81 | 18.86 |

The oil viscosity before and after application of the process according to the present invention was determined by Stabinger: ASTM D7042

TABLE 5

Viscosity before and after the application of the process according to the invention

| Sample type | Viscosity at 50° C. Dynamic mPa s | Viscosity at 50° C. Kinematic mm2/s |
|---|---|---|
| oil before treatment | 28076.0 | 27983.0 |
| oil after treatment | 2615.0 | 2646.6 |

From Table 4 and 5, it is apparent that the application of the procedures according to the present invention produces oil of better quality and substantially less viscosity, which indicates that heavy oil is converted to a significantly lighter oil which is far more suitable for exploitation.

The invention claimed is:

1. A method for improved oil recovery by action of an electric field of a direct current and a pulsating electromagnetic field on an oil layer (6) within reservoir rock beneath a ground surface, wherein the method comprises:

a) selecting submerged reservoir rock formation clusters that contain oil within the oil layer;

b) selecting one or more boreholes;

c) extracting oil from at least one borehole of the one or more boreholes;

the method further comprises the following steps:

A. connecting an electrode (7, 8) with a source of the direct current (1), whereby the electrode comprises at least one of a steel casing (17) and upstream production tubing (16) of the one or more boreholes;

B. connecting of the source of the direct current (1) with a source of the pulsating electromagnetic field (2), wherein the source of the pulsating electromagnetic field (2) is situated on the ground surface;

C. applying the electric field of the direct current to the electrode (7, 8); and D. emitting the pulsating electromagnetic field (3) from the source of the pulsating electromagnetic field (2) into the oil layer (6) through the ground surface, thereby decreasing oil capillary attraction affinity of the reservoir rock, and simultaneously increasing water capillary attraction affinity of the reservoir rock to capillary attract water, together with reducing viscosity of the oil and increasing electro osmotic flow of the oil and layered water;

wherein the source of the pulsating electromagnetic field (2) is at least one coil or dipole antenna.

2. The method, according to claim 1, further comprising:

performing surface measurements of voltage between a static electrode and a mobile electrode that is moving in five-degree steps:

determining a direction of a natural polarization of the oil layer (6) based on the surface measurements; and aligning at least one of the source of the direct current (1) and the source of the pulsating electromagnetic field (2) such that a direction of polarization of the electric field, induced by the one of the source of the direct current (1) and the source of the pulsating electromagnetic field (2), is aligned with the direction of the natural polarization of the oil layer (6).

3. The method according to claim 2, wherein the direction of polarization of the electric field, induced by the one of the source of the direct current (1) and the source of the pulsating electromagnetic field (2), does not deviate from the direction of the natural polarization of the oil layer by more than 45 degrees.

4. The method according to claim 1, wherein the electrode (7, 8) is electrically insulated from a surface collecting system (11) by inserting tubes of non-volatile electrically insulating material (12) between the electrode (7, 8) and the surface collecting system (11).

5. The method according to claim 1, wherein one selected borehole of the one or more boreholes comprises one basic channel and a side channel (23), wherein the one basic channel is used as one of: an anode electrode and a cathode electrode, the one selected borehole includes a casing (17) and a tubing (16) and a plus pole is connected to the casing (17) and a minus pole to the tubing (16).

6. The method according to claim 5, wherein a portion of the casing in the one basic channel is replaced by electrical insulation placed proximate to an outlet of the side channel (23).

7. The method according to claim 6, further comprising electrical insulation between the tubing (16) and the casing (17) of the one selected borehole, the electrical insulation comprising a tubing holder made of non-conductive material (20) and annular distancers (21) between the tubing (16) and the casing (17) of the one selected borehole so as to prevent contact of the tubing (16) and the casing (17) of the one selected borehole.

8. The method according to claim 6, wherein a flow of fluid in an annular space of the one selected borehole is prevented by insertion of a packer (24) over connected casing perforations (18) while a flow of the fluid in a side channel space (23) is prevented by insertion of a cap over the connected casing perforations (18).

9. The method according to claim 1, wherein energy supplied by the source of the direct current (1) is in a range of 0.5 to 3 kWh.

10. The method according to claim 1, wherein energy supplied by the source of the pulsating electromagnetic field (2) is in a range of 0.5 to 3 kWh.

11. The method according to claim 1, wherein the source of the direct current (1) and the source of the pulsating electromagnetic field (2) combined do not consume more than 3 kWh.

12. The method according to claim 9, wherein the source of the direct current (1) provides a voltage of 5 mV to 100 mV per meter of distance between anode and cathode electrodes (7, 8).

13. The method according to claim 2, wherein the one or more boreholes comprises a first borehole having both the steel casing (17) and the upstream production tubing (16), and wherein the steel casing (17) of the first borehole and the upstream production tubing (16) of the first borehole are electrically insulated from a surface collecting system (11) by inserting tubes of non-volatile electrically insulating material (12) between the upstream production tubing (16) of the first borehole and the surface collecting system (11).

14. The method according to claim 3, wherein the one or more boreholes comprises a first borehole having both the steel casing (17) and the upstream production tubing (16), and wherein the steel casing (17) of the first borehole and the upstream production tubing (16) of the first borehole are electrically insulated from a surface collecting system (11) by inserting tubes of non-volatile electrically insulating material (12) between the upstream production tubing (16) and the surface collecting system (11).

15. The method according to claim 2, wherein one selected borehole with one basic channel and one or more side channels (23) is used as an anode electrode and a cathode electrode, the one selected borehole including the steel casing (17) and the upstream production tubing (16) and a plus pole is connected to the steel casing (17) and a minus pole to the upstream production tubing (16).

16. The method according to claim 3, wherein one selected borehole with one basic channel and one or more side channels (23) is used as an anode electrode and a cathode electrode, the one selected borehole includes the steel casing (17) and the upstream production tubing (16) and a plus pole is connected to the steel casing (17) and a minus pole to the upstream production tubing (16).

17. The method according to claim 9, wherein the source of the direct current (1) and the source of the pulsating electromagnetic field (2) combined do not consume more than 3 kWh.

18. The method according to claim 10, wherein the source of the direct current (1) and the source of the pulsating electromagnetic field (2) combined do not consume more than 3 kWh.

19. A borehole system for improved oil recovery by the action of an electric field of a direct current and a pulsating electromagnetic field on an oil layer within reservoir rock beneath a ground surface, wherein the borehole system comprising:

a borehole connected to submerged reservoir rock formation clusters that contain oil within the oil layer;

a source of the direct current connected to the borehole, wherein the source of the direct current is configured to apply the direct current into the oil layer through the borehole; and a source of the pulsating electromagnetic field situated on the ground surface, wherein the source of the pulsating electromagnetic field is configured to emit the pulsating electromagnetic field from the source of the pulsating electromagnetic field into the oil layer through the ground surface, wherein applying both the direct current to the oil layer through the borehole and applying the pulsating electromagnetic field into the oil layer through the ground surface decreases oil capillary attraction affinity of the reservoir rock, and simultaneously increases water capillary attraction affinity of the reservoir rock to attract water, together with reducing viscosity of the oil and increasing electro osmotic flow of the oil and layered water.

20. The borehole system according to claim 19, wherein the borehole comprises a steel casing and an upstream production tubing, and wherein the source of the direct current connected to the borehole via one of: the steel casing and the upstream production tubing.

* * * * *